US011174540B2

(12) United States Patent
Kawabe et al.

(10) Patent No.: US 11,174,540 B2
(45) Date of Patent: Nov. 16, 2021

(54) HOT-ROLLED AND ANNEALED FERRITIC STAINLESS STEEL SHEET AND METHOD FOR MANUFACTURING THE SAME

(71) Applicant: JFE Steel Corporation, Tokyo (JP)

(72) Inventors: Hidetaka Kawabe, Tokyo (JP); Mitsuyuki Fujisawa, Tokyo (JP); Hiroshi Shimizu, Tokyo (JP); Tomohiko Uchino, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/636,792

(22) PCT Filed: Sep. 21, 2018

(86) PCT No.: PCT/JP2018/035099
§ 371 (c)(1),
(2) Date: Feb. 5, 2020

(87) PCT Pub. No.: WO2019/065508
PCT Pub. Date: Apr. 4, 2019

(65) Prior Publication Data

US 2020/0377980 A1 Dec. 3, 2020

(30) Foreign Application Priority Data

Sep. 29, 2017 (JP) ..... JP2017-191034

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/50*** | (2006.01) |
| ***C22C 38/60*** | (2006.01) |
| ***C21D 9/46*** | (2006.01) |
| ***C22C 38/00*** | (2006.01) |
| ***C22C 38/46*** | (2006.01) |
| ***C22C 38/48*** | (2006.01) |
| ***C22C 38/54*** | (2006.01) |

(52) U.S. Cl.
CPC ..... *C22C 38/60* (2013.01); *C21D 8/0226* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/46* (2013.01); *C22C 38/48* (2013.01); *C22C 38/50* (2013.01); *C22C 38/54* (2013.01)

(58) Field of Classification Search
None
See application file for complete search history.

(56) References Cited

U.S. PATENT DOCUMENTS

| | | | | |
|---|---|---|---|---|
| 2002/0074067 | A1* | 6/2002 | Ota | C21D 8/0263 148/610 |
| 2005/0173033 | A1 | 8/2005 | Yazawa et al. | |
| 2014/0216614 | A1 | 8/2014 | Hatano et al. | |
| 2016/0369368 | A1 | 12/2016 | Yoshino et al. | |
| 2017/0107593 | A1 | 4/2017 | Hamada et al. | |

FOREIGN PATENT DOCUMENTS

| | | | |
|---|---|---|---|
| CN | 101328561 | A | 12/2008 |
| CN | 102465198 | A | 5/2012 |
| CN | 102839328 | A | 12/2012 |
| EP | 1083237 | A2 | 3/2001 |
| JP | 06279949 | A | 10/1994 |
| JP | 07216514 | A | 8/1995 |
| JP | 09256065 | A | 9/1997 |
| JP | 09287060 | A | 11/1997 |
| JP | 2001181798 | A | 7/2001 |
| JP | 2001192735 | A | 7/2001 |
| JP | 2001207244 | A | 7/2001 |
| JP | 3241114 | B2 | 12/2001 |
| JP | 3510787 | B2 | 3/2004 |
| JP | 2006328524 | A | 12/2006 |
| JP | 2012140687 | A | 7/2012 |
| JP | 5307170 | B2 | 10/2013 |
| JP | 2015187290 | A | 10/2015 |
| JP | 5908936 | B2 | 4/2016 |

OTHER PUBLICATIONS

Extended European Search Report for European Application No. 18863317.6, dated Jun. 9, 2020, 10 pages.
International Search Report and Written Opinion for International Application No. PCT/JP2018/035099, dated Dec. 4, 2018, 5 pages.
Chinese Office Action with Search Report for Chinese Application No. 201880051166.2, dated Mar. 1, 2021, 9 pages.
Korean Office Action for Korean Application No. 10-2020-7003378, dated Sep. 30, 2021 with Concise Statement of Relevance of Office Action, 5 pages.

* cited by examiner

*Primary Examiner* — Adam Krupicka
(74) *Attorney, Agent, or Firm* — RatnerPrestia

(57) ABSTRACT

Provided is a hot-rolled and annealed ferritic stainless steel sheet excellent in surface quality after bending work has been performed.
A hot-rolled and annealed ferritic stainless steel sheet has a thickness of 5.0 mm or more and a chemical composition containing, by mass %, C: 0.001% to 0.025%, Si: 0.05% to 0.70%, Mn: 0.05% to 0.50%, P: 0.050% or less, S: 0.01% or less, Cr: 10.0% to 18.0%, Ni: 0.01% to 1.00%, Al: 0.001% to 0.10%, N: 0.001% to 0.025%, Ti: 0.01% to 0.40%, and a balance of Fe and inevitable impurities, in which a difference between maximum and minimum values of an average crystal grain diameter determined by using measuring method 1 is 50 μm or less, and in which a difference between maximum and minimum values of a crystal grain elongation rate determined by using measuring method 2 is 5.0 or less.

8 Claims, No Drawings

HOT-ROLLED AND ANNEALED FERRITIC STAINLESS STEEL SHEET AND METHOD FOR MANUFACTURING THE SAME

CROSS REFERENCE TO RELATED APPLICATIONS

This is the U.S. National Phase application of PCT/JP2018/035099, filed Sep. 21, 2018 which claims priority to Japanese Patent Application No. 2017-191034, filed Sep. 29, 2017, the disclosures of these applications being incorporated herein by reference in their entireties for all purposes.

FIELD OF THE INVENTION

The present invention relates to a hot-rolled and annealed ferritic stainless steel sheet. In particular, the present invention relates to a hot-rolled and annealed ferritic stainless steel sheet excellent in surface quality after bending work has been performed.

BACKGROUND OF THE INVENTION

Since ferritic stainless steel is less expensive than austenitic stainless steel, which contains a large amount of expensive Ni, ferritic stainless steel is used in many applications. For example, stainless steel sheets are used for brackets used for automobile parts. Since various parts are attached to the brackets, for example, by using bolts or by using a welding method, thick stainless steel sheets are used for the brackets from the viewpoint of achieving satisfactory stiffness, and there is a case where the stainless steel sheet to be used is formed into parts having a specified shape by performing press work. However, there is a problem regarding surface appearance in that, for example, a streaky pattern, wrinkling, or a rough surface may appear on the surface of the parts after press work has been performed. To date, various investigations have been conducted regarding, for example, the material properties, bending workability, and surface quality of thick stainless steel sheets.

As an example of a technique regarding a thick material, Patent Literature 1 discloses a technique in which the low-temperature toughness of a thick ferritic stainless steel sheet having a thickness of 5 mm or more, which is subjected to shearing or punching work instead of bending work and used for a flange, is improved by controlling the crystal orientation of the steel sheet. As an example of a technique regarding surface quality after work has been performed, Patent Literature 2 discloses a technique in which a rough surface due to work of a cold-rolled and annealed steel sheet after cylindrical deep drawing has been performed is improved by controlling the chemical composition of steel, precipitates, and crystal grain diameter of the steel sheet. In addition, Patent Literature 3 discloses a manufacturing method in which, by optimizing the amount of austenite when hot rolling is performed, a cold-rolled and annealed steel sheet is provided with excellent ridging resistance after a strain of 20% has been applied to the steel sheet by performing tensile work in which the steel sheet is homogeneously deformed. As an example of a technique regarding the bending workability of a high-strength and high-toughness stainless steel sheet having a ferrite-martensite dual phase microstructure or a martensite single phase microstructure, Patent Literature 4 discloses a technique in which bendability is improved by inhibiting cracking from occurring on a ridge line at a bending position as a result of controlling the shape of MnS-based inclusion grains. As an example of a technique regarding wrinkle depth after bending work has been performed, Patent Literature 5 discloses a technique in which the depth of wrinkles, which are formed on the outer peripheral surface of a bending position after bending work has been performed to an angle of 90° with a curvature radius of 2 mm, is decreased by controlling the ratio of the hardness of the surface layer in the thickness direction of the steel sheet to the hardness of the central portion in the thickness direction of the steel sheet in the case of a hot-rolled steel sheet (which has not been subjected to a hot-rolled-sheet annealing process) having a worked microstructure due to rolling, that is, a non-recrystallized metallographic structure and accumulated strain due to work, which is obtained by performing hot rolling at a low temperature, with a low friction coefficient, and with high rolling reduction in a posterior rolling stage, that is, at a hot rolling temperature of 800° C. or lower, with a friction coefficient of 0.2 or less in the last three rolling passes, and with an accumulated rolling reduction ratio of 50% or more in the last three rolling passes.

PATENT LITERATURE

PTL 1: Japanese Patent No. 5908936
PTL 2: Japanese Patent No. 5307170
PTL 3: Japanese Patent No. 3241114
PTL 4: Japanese Patent No. 3510787
PTL 5: Japanese Unexamined Patent Application Publication No. 2001-181798

SUMMARY OF THE INVENTION

When a conventional ferritic stainless steel sheet is used for a thick part such as a bracket, there is a case where it is not possible to achieve good surface quality after press work has been performed. In the case of such an application, since it is difficult to deal with such a problem by using the conventional technique disclosed in Patent Literature 1, there is a risk that it is impossible to achieve excellent surface quality after bending work has been performed. Also, it is difficult to deal with such a problem by using the techniques disclosed in Patent Literature 2, Patent Literature 3, and Patent Literature 4 since no investigation is conducted to improve surface quality after bending work has been performed. Also, in the case of the technique disclosed in Patent Literature 5, it is not possible to obtain knowledge regarding an improvement in the surface quality of a thick hot-rolled and annealed steel sheet having a recrystallized microstructure after bending work, which is greatly influenced by thickness, has been performed.

An object according to aspects of the present invention is to provide a hot-rolled and annealed ferritic stainless steel sheet excellent in surface quality after bending work has been performed and a method for manufacturing the steel sheet.

To solve the problems described above, the present inventors have conducted detailed investigations regarding the surface quality of a hot-rolled and annealed ferritic stainless steel sheet after bending work has been performed which is used for thick parts in relation to a chemical composition and to a microstructure and a surface (rolled surface) in a manufacturing process and, as a result, have found that, regarding improvement of the surface quality of a thick hot-rolled and annealed ferritic stainless steel sheet having a thickness of, for example, 5.0 mm or more after bending work has been performed, it is significantly effective to specify a chemical composition and a manufacturing method to form a homogeneous microstructure as a result of decreasing a difference between the maximum and minimum values of an average crystal grain diameter, where the average crystal grain diameter is determined at plural observation positions arranged in the thickness direction, and decreasing a difference between the maximum and minimum values of an elongation rate of crystal grains distributed in the thickness direction (=(crystal grain length in the rolling direction)/(crystal grain thickness in the thickness direction)).

The present inventors completed the present invention by conducting additional investigations. The subject matter according to aspects of the present invention is as follows.

[1] A hot-rolled and annealed ferritic stainless steel sheet, having a chemical composition containing, by mass %, C: 0.001% to 0.025%, Si: 0.05% to 0.70%, Mn: 0.05% to 0.50%, P: 0.050% or less, S: 0.01% or less, Cr: 10.0% to 18.0%, Ni: 0.01% to 1.00%, Al: 0.001% to 0.10%, N: 0.001% to 0.025%, Ti: 0.01% to 0.40%, and a balance of Fe and inevitable impurities, in which a difference between maximum and minimum values of an average crystal grain diameter determined by using measuring method 1 below is 50 μm or less, a and in which a difference between maximum and minimum values of a crystal grain elongation rate determined by using measuring method 2 below is 5.0 or less.

(Measuring Method 1)

At each of 9 observation positions, which are a surface layer including a front surface, a position at ⅛ of the thickness, a position at ⅜ of the thickness, a position at ⅜ of the thickness, a position at ⅝ of the thickness, a position at ⅝ of the thickness, a position at ⅞ of the thickness, and a surface layer including a back surface, an average crystal grain diameter is calculated as the square root of a value obtained by dividing the area of an observation region by the number of crystal grains contained in the observation region, where the observation region is in a thickness cross section parallel to a rolling direction and has a length in the rolling direction of 1800 μm and a length in a thickness direction of 1000 μm, which is expressed by $(1800\times1000/(\text{number of crystal grains contained in the observation region}))^{1/2}$, and a difference between the maximum and minimum values of the average crystal grain diameter is obtained from the 9 calculated average crystal grain diameters.

(Measuring Method 2)

At each of 9 observation positions, which are a surface layer including a front surface, a position at ⅛ of the thickness, a position at ⅜ of the thickness, a position at ⅜ of the thickness, a position at ⅝ of the thickness, a position at ⅝ of the thickness, a position at ⅞ of the thickness, and a surface layer including a back surface, an elongation rate is calculated by dividing a crystal grain length in the rolling direction by a crystal grain thickness in the thickness direction, where the observation region is in a thickness cross section parallel to the rolling direction and has a length in the rolling direction of 1800 μm and a length in the thickness direction of 1000 μm, where the crystal grain length in the rolling direction is calculated by dividing 1800 μm by an average number of crystal grain boundaries distributed in the rolling direction, which is obtained by drawing 5 lines having a length of 1800 μm in the rolling direction in the observation region, by counting the number of crystal grain boundaries intersecting each of the 5 lines, and by calculating the average value of the numbers counted on the 5 lines, and where the crystal grain thickness in the thickness direction is calculated by dividing 1000 μm by an average number of crystal grain boundaries distributed in the thickness direction, which is obtained by drawing 5 lines having a length of 1000 μm in the thickness direction in the observation region, by counting the number of crystal grain boundaries intersecting each of the 5 lines, and by calculating the average value of the numbers counted on the 5 lines, and a difference between the maximum and minimum values of the elongation rate is obtained from the 9 calculated elongation rates.

[2] The hot-rolled and annealed ferritic stainless steel sheet according to item [1], in which the chemical composition further contains, by mass %, one, two, or all of Cu: 0.01% to 1.00%, Mo: 0.01% to 1.00%, and Co: 0.01% to 0.50%.

[3] The hot-rolled and annealed ferritic stainless steel sheet according to item [1] or [2], in which the chemical composition further contains, by mass %, one, two, or more selected from V: 0.01% to 0.10%, Zr: 0.01% to 0.10%, Nb: 0.01% to 0.10%, B: 0.0003% to 0.0030%, Mg: 0.0005% to 0.0030%, Ca: 0.0003% to 0.0030%, Y: 0.01% to 0.20%, REM (rare-earth metal): 0.01% to 0.10%, Sn: 0.001% to 0.500%, and Sb: 0.001% to 0.500%.

[4] A method for manufacturing the hot-rolled and annealed ferritic stainless steel sheet according to any one of items [1] to [3], the method including a hot rolling process of performing hot rolling with a rolling finishing temperature of 800° C. to 950° C. to obtain a hot-rolled steel sheet, and a process of performing hot-rolled-sheet annealing on the hot-rolled steel sheet by heating the hot-rolled steel sheet at a heating rate of 5° C./hour to 100° C./hour from a temperature of 200° C. to a hot-rolled-sheet annealing temperature of 700° C. to 900° C. and by holding the heated steel sheet at a temperature of 700° C. to 900° C. for 1 hour to 50 hours.

The hot-rolled and annealed ferritic stainless steel sheet according to aspects of the present invention is excellent in surface quality after bending work has been performed.

DETAILED DESCRIPTION OF EMBODIMENTS OF THE INVENTION

Hereafter, the embodiments of the present invention will be described. Here, the present invention is not limited to the embodiments below.

First, the reasons for limitations on the chemical composition of the hot-rolled and annealed ferritic stainless steel sheet according to aspects of the present invention will be described. "%" used when describing a chemical composition denotes "mass %", unless otherwise noted.

C: 0.001% to 0.025%

In the case where the C content is excessively large, since C is inhomogeneously and locally precipitated in the form of carbides having inhomogeneous grain sizes in steel, equiaxed recrystallized grain growth is inhibited, which results in a deterioration in surface quality after bending work has been performed due to the formation of a microstructure having elongated grains. It is preferable that the C content be as small as possible, and, in accordance with aspects of the present invention, the C content is set to be 0.025% or less. It is preferable that the C content be 0.010% or less. On the other hand, in the case where an attempt is made to excessively decrease the C content, there is an increase in steel making costs. Therefore, the lower limit of the C content is set to be 0.001%. It is preferable that the C content be 0.005% or more.

Si: 0.05% to 0.70%

Although Si contributes to the deoxidation of steel, it is not possible to obtain such an effect in the case where the Si content is less than 0.05%. Therefore, the Si content is set to be 0.05% or more, preferably 0.15% or more, or more preferably 0.20% or more. On the other hand, in the case where the Si content is more than 0.70%, since there is an increase in the hardness of steel, there is a harmful effect on bendability. Therefore, the Si content is 0.70% or less. It is preferable that the Si content be 0.60% or less or more preferably 0.40% or less.

Mn: 0.05% to 0.50%

Although Mn is effective for forming a homogeneous microstructure by decreasing the grain diameter of a microstructure, it is not possible to obtain such an effect in the case where the Mn content is less than 0.05%. Therefore, the Mn content is set to be 0.05% or more. It is preferable that the Mn content be 0.15% or more or more preferably 0.25% or more. However, in the case where the Mn content is excessively large, since a large amount of MnS is formed, there is a harmful effect on corrosion resistance. Therefore, the Mn content is 0.50% or less. It is preferable that the Mn content be 0.45% or less or more preferably 0.40% or less.

P: 0.050% or less

In the case where the P content is more than 0.050%, P is segregated at grain boundaries, and P is inhomogeneously and locally precipitated in the form of, for example, FeTiP having inhomogeneous sizes in steel. As a result, in the case where the P content is excessively large, equiaxed recrystallized grain growth is inhibited, which results in a deterioration in surface quality after bending work has been performed due to the formation of a microstructure having elongated grains. Therefore, it is preferable that the P content be as small as possible. Moreover, in the case where the P content is excessively large, there is also a harmful effect on corrosion resistance. Therefore, the P content is set to be 0.050% or less. It is preferable that the P content be 0.040% or less. There is no particular limitation on the lower limit of the P content, because it is preferable that the P content be as small as possible. However, it is preferable that the lower limit of the P content be 0.01%, because there is an increase in steel making costs in the case where an attempt is made to excessively decrease the P content.

S: 0.01% or less

Since S has a harmful effect on corrosion resistance by forming MnS-based inclusions, it is preferable that the S content be as small as possible. Therefore, in accordance with aspects of the present invention, the S content is set to be 0.01% or less. It is preferable that the S content be 0.005% or less or more preferably 0.004% or less. There is no particular limitation on the lower limit of the S content, because it is preferable that the S content be as small as possible. However, it is preferable that the lower limit of the S content be 0.0003%, because there is an increase in steel making costs in the case where an attempt is made to excessively decrease the S content.

Cr: 10.0% to 18.0%

Since Cr is an element which improves corrosion resistance, Cr is an element indispensable for a ferritic stainless steel sheet. Since such an effect is obtained in the case where the Cr content is 10.0% or more, the Cr content is set to be 10.0% or more. It is preferable that the Cr content be 10.5% or more. On the other hand, in the case where the Cr content is more than 18.0%, there is a significant decrease in elongation. Therefore, the Cr content is set to be 18.0% or less. It is preferable that the Cr content be 15.0% or less or more preferably 13.0% or less.

Ni: 0.01% to 1.00%

Ni is an element which is effective for improving corrosion resistance and toughness. Such effects are obtained in the case where the Ni content is 0.01% or more. On the other hand, in the case where the Ni content is more than 1.00%, there is a harmful effect on bendability. Therefore, the Ni content is set to be 1.00% or less. It is preferable that the Ni content be 0.05% or more or more preferably 0.10% or more. In addition, it is preferable that the Ni content be 0.60% or less or more preferably 0.40% or less.

Al: 0.001% to 0.10%

Al is an element which is effective as a deoxidation agent. Such an effect is obtained in the case where the Al content is 0.001% or more. However, in the where the Al content is more than 0.10%, Al is inhomogeneously and locally precipitated in the form of Al-based inclusions such as AlN having inhomogeneous sizes at ferrite grain boundaries in steel. As a result, in the case where the Al content is excessively large, equiaxed recrystallized grain growth is inhibited, which results in a deterioration in surface quality after bending work has been performed due to the formation of a microstructure having elongated grains. Therefore, the upper limit of the Al content is set to be 0.10%. It is preferable that the Al content be 0.060% or less or more preferably 0.040% or less.

N: 0.001% to 0.025%

Since N causes a deterioration in corrosion resistance by forming Cr nitrides, it is preferable that the N content be as small as possible. Therefore, in accordance with aspects of the present invention, the N content is set to be 0.025% or less. It is preferable that the N content be 0.010% or less. On the other hand, in the case where an attempt is made to excessively decrease the N content, there is an increase in steel making costs. Therefore, the lower limit of the N content is set to be 0.001%. It is preferable that the N content be 0.003% or more.

Ti: 0.01% to 0.40%

Ti, which is a carbonitride-forming element, suppresses a deterioration in corrosion resistance, which is caused by sensitization, by fixing C and N. Such an effect is obtained in the case where the Ti content is 0.01% or more. Therefore, the Ti content is set to be 0.01% or more. On the other hand, in the case where the Ti content is more than 0.40%, since Ti is inhomogeneously and locally precipitated in the form of carbides having inhomogeneous sizes in steel, equiaxed recrystallized grain growth is inhibited, which results in a deterioration in surface quality after bending work has been performed due to the formation of a microstructure having elongated grains. Therefore, the upper limit of the Ti content is set to be 0.40%. It is preferable that the Ti content be 0.30% or less.

C, P, Al, and Ti exist in the form of precipitates in steel. Therefore, in the case where the content of one of these elements is excessively large, there is an influence on a variation in the elongation rate of crystal grains distributed in the thickness direction. The reason why there is a variation in the elongation rate is as follows. Since the surface layer in the thickness direction is exposed to a high temperature for longer than the central portion in the thickness direction when heating for hot rolling or hot-rolled-sheet annealing is performed, the amount of dissolution precipitates is larger in the surface layer than in the central portion in the thickness direction. Therefore, the amount of precipitates formed by reprecipitation due to a decrease in the temperature of a steel sheet is larger in the surface layer than in the central portion in the thickness direction. Since precipitates formed by reprecipitation exist finely and homogeneously, recrystallized grains tend to be equiaxed grains. On the other hand, since the heating rate of the central portion in the thickness direction is smaller than that of the surface layer in the thickness direction, the central portion is exposed to a low temperature for a long time, which results in the amount of precipitates redissolved being small. Therefore, undissolved precipitates having a large grain diameter exist inhomogeneously and locally, which results in a decreased tendency for recrystallized grains to be equiaxed grains. Therefore, while the elongation rate is comparatively small in the surface layer, it is difficult to form a microstructure having equiaxed grains in the central portion in the thickness direction, which results in an increase in the elongation rate. As a result, a difference between the maximum and minimum values of the elongation rate of crystal grains distributed in the thickness direction becomes more than 5.0, which results in a deterioration in surface quality after bending work is performed.

The elements described above are the basic chemical composition according to aspects of the present invention, and the remainder which is different from the basic chemical composition described above may be Fe and inevitable impurities. In accordance with aspects of the present invention, by mass %, one, two, or all of Cu: 0.01% to 1.00%, Mo: 0.01% to 1.00%, and Co: 0.01% to 0.50% may further be contained as optional elements.

Cu: 0.01% to 1.00%

Cu is effective for improving corrosion resistance. On the other hand, in the case where the Cu content is excessively large, there is a harmful effect on bendability due to an increase in the hardness of steel. Therefore, in the case where Cu is contained, it is necessary that the Cu content be 0.01% to 1.00%. In the case where Cu is contained, it is preferable that the Cu content be 0.10% or more or more preferably 0.20% or more. In addition, in the case where Cu is contained, it is preferable that the Cu content be 0.80% or less or more preferably 0.50% or less.

Mo: 0.01% to 1.00%

Mo is effective for improving corrosion resistance. On the other hand, in the case where the Mo content is excessively large, there is a harmful effect on bendability due to an increase in the hardness of steel. Therefore, in the case where Mo is contained, it is necessary that the Mo content be 0.01% to 1.00%. In the case where Mo is contained, it is preferable that the Mo content be 0.10% or more or more preferably 0.20% or more. In addition, in the case where Mo is contained, it is preferable that the Mo content be 0.80% or less or more preferably 0.50% or less.

Co: 0.01% to 0.50%

Co is effective for improving crevice corrosion resistance. On the other hand, in the case where the Co content is excessively large, there is a harmful effect on bendability due to an increase in the hardness of steel. Therefore, in the case where Co is contained, it is necessary that the Co content be 0.01% to 0.50%. In the case where Co is contained, it is preferable that the Co content be 0.05% or more. In addition, in the case where Co is contained, it is preferable that the Co content be 0.30% or less or more preferably 0.10% or less.

In addition, by mass %, one, two, or more selected from V: 0.01% to 0.10%, Zr: 0.01% to 0.10%, Nb: 0.01% to 0.10%, B: 0.0003% to 0.0030%, Mg: 0.0005% to 0.0030%, Ca: 0.0003% to 0.0030%, Y: 0.01% to 0.20%, REM (rare-earth metal): 0.01% to 0.10%, Sn: 0.001% to 0.500%, and Sb: 0.001% to 0.500% may further be contained as optional elements.

V: 0.01% to 0.10%

V, which is an element having a high affinity for C and N, is effective for improving workability by decreasing the amounts of dissolved C and dissolved N in a matrix phase as a result of being precipitated in the form of carbides or nitrides when hot rolling is performed. On the other hand, in the case where the V content is excessively large, there is a harmful effect on bendability due to an increase in the hardness of steel. Therefore, in the case where V is contained, it is necessary that the V content be 0.01% to 0.10%. In the case where V is contained, it is preferable that the V content be 0.02% or more. In addition, in the case where V is contained, it is preferable that the V content be 0.05% or less.

Zr: 0.01% to 0.10%

Zr, which is an element having a high affinity for C and N, is effective for improving workability by decreasing the amounts of dissolved C and dissolved N in a parent phase as a result of being precipitated in the form of carbides or nitrides when hot rolling is performed. On the other hand, in the case where the Zr content is excessively large, there is a harmful effect on bendability due to an increase in the hardness of steel. Therefore, in the case where Zr is contained, it is necessary that the Zr content be 0.01% to 0.10%. In the case where Zr is contained, it is preferable that the Zr content be 0.02% or more. In addition, in the case where Zr is contained, it is preferable that the Zr content be 0.05% or less.

Nb: 0.01% to 0.10%

Nb, which is an element having a high affinity for C and N, is effective for improving workability by decreasing the amounts of dissolved C and dissolved N in a parent phase as a result of being precipitated in the form of carbides or nitrides when hot rolling is performed. On the other hand, in the case where the Nb content is excessively large, there is a harmful effect on bendability due to an increase in the hardness of steel. Therefore, in the case where Nb is contained, it is necessary that the Nb content be 0.01% to 0.10%. In the case where Nb is contained, it is preferable that the Nb content be 0.02% or more. In addition, in the case where Nb is contained, it is preferable that the Nb content be 0.05% or less.

B: 0.0003% to 0.0030%

B is an element which is effective for preventing secondary cold work embrittlement. On the other hand, in the case where the B content is excessively large, there is a deterioration in hot workability. Therefore, in the case where B is contained, the B content is set to be 0.0003% to 0.0030%. In the case where B is contained, it is preferable that the B content be 0.0005% or more. In addition, in the case where B is contained, it is preferable that the B content be 0.0020% or less.

Mg: 0.0005% to 0.0030%

Mg functions as a deoxidation agent along with Al by forming Mg oxides in molten steel. On the other hand, in the case where the Mg content is excessively large, there is a deterioration in manufacturability due to a deterioration in the toughness of steel. Therefore, in the case where Mg is contained, the Mg content is set to be 0.0005% to 0.0030%. In the case where Mg is contained, it is preferable that the Mg content be 0.0010% or more. In addition, in the case where Mg is contained, it is preferable that the Mg content be 0.0020% or less.

Ca: 0.0003% to 0.0030%

Ca is an element which improves hot workability. On the other hand, in the case where the Ca content is excessively large, there is a deterioration in manufacturability due to a deterioration in the toughness of steel, and there is a deterioration in corrosion resistance due to the precipitation of CaS. Therefore, in the case where Ca is contained, the Ca content is set to be 0.0003% to 0.0030%. In the case where Ca is contained, it is preferable that the Ca content be 0.0005% or more. In addition, in the case where Ca is contained, it is preferable that the Ca content be 0.0020% or less.

Y: 0.01% to 0.20%

Y is an element which improves cleanliness by decreasing the amount of decrease in the viscosity of molten steel. On the other hand, in the case where the Y content is excessively large, such an effect becomes saturated, and there is a deterioration in workability. Therefore, in the case where Y is contained, the Y content is set to be 0.01% to 0.20%. In the case where Y is contained, it is preferable that the Y content be 0.03% or more. In addition, in the case where Y is contained, it is preferable that the Y content be 0.10% or less.

REM (rare-earth metal): 0.01% to 0.10%

REM (rare-earth metal: elements having atomic numbers of 57 through 71 such as La, Ce, and Nd) is an element which improves high-temperature oxidation resistance. On the other hand, in the case where the REM content is excessively large, such an effect becomes saturated, and there is a deterioration in manufacturability due to surface defects occurring when hot rolling is performed. Therefore, in the case where REM is contained, the REM content is set to be 0.01% to 0.10%. In the case where REM is contained, it is preferable that the REM content be 0.03% or more. In addition, in the case where REM is contained, it is preferable that the REM content be 0.05% or less.

Sn: 0.001% to 0.500%

Sn is effective for improving workability by promoting the formation of a deformation zone when rolling is performed. On the other hand, in the case where the Sn content is excessively large, such an effect becomes saturated, and there is a deterioration in workability. Therefore, in the case where Sn is contained, the Sn content is set to be 0.001% to 0.500%. In the case where Sn is contained, it is preferable that the Sn content be 0.003% or more. In addition, in the case where Sn is contained, it is preferable that the Sn content be 0.200% or less.

Sb: 0.001% to 0.500%

Sb is effective for improving workability by promoting the formation of a deformation zone when rolling is performed. On the other hand, in the case where the Sb content is excessively large, such an effect becomes saturated, and there is a deterioration in workability. Therefore, in the case where Sb is contained, the Sb content is set to be 0.001% to 0.500%. In the case where Sb is contained, it is preferable that the Sb content be 0.003% or more. In addition, in the case where Sb is contained, it is preferable that the Sb content be 0.200% or less.

In addition, in the case where the content of one of the optional elements described above is less than the lower limit, such an element is regarded as being contained as an inevitable impurity.

In bending work, tensile strain increases from the bending neutral axis toward the outer surface layer, and the tensile strain applied to the surface layer is larger in the case of a material having a large thickness than in the case of a material having a small thickness. In addition, since the volume between the surface layer and the central portion is larger in the case of a material having a large thickness than in the case of a material having a small thickness, the influence of a microstructure in the thickness direction when bending work is performed is larger in the case of a material having a large thickness than in the case of a material having a small thickness. Therefore, achieving satisfactory microstructure homogeneity is important for improving the surface quality of a thick hot-rolled and annealed ferritic stainless steel sheet having a thickness of 5.0 mm or more after bending work has been performed.

The present inventors have found that, to improve the surface quality of a hot-rolled and annealed ferritic stainless steel sheet after bending work has been performed, it is significantly effective to specify a chemical composition and a manufacturing method to form a homogeneous microstructure in the thickness direction as a result of decreasing a difference between the maximum and minimum values of an average diameter of crystal grains distributed in the thickness direction to 50 μm or less and decreasing a difference between the maximum and minimum values of an elongation rate of crystal grains distributed in the thickness direction to 5.0 or less, that is, as a result of decreasing a variation in the diameter of crystal grains distributed in the thickness direction and a variation in the shape of crystal grains distributed in the thickness direction.

Difference between maximum and minimum values of average crystal grain diameter

In the case of the hot-rolled and annealed ferritic stainless steel sheet according to aspects of the present invention, a difference between maximum and minimum values of an average crystal grain diameter determined by using measuring method 1 below is 50 μm or less. In the case where the difference described above is more than 50 μm, it is not possible to achieve good surface quality after bending work has been performed. There is no particular limitation on the lower limit of the difference, and the difference described above may be 0 μm.

(Measuring Method 1)

At each of 9 observation positions, which are a surface layer including a front surface, a position at ⅛ of the thickness, a position at ⅜ of the thickness, a position at ⅜ of the thickness, a position at ⅜ of the thickness, a position at ⅝ of the thickness, a position at ⅝ of the thickness, a position at ⅞ of the thickness, and a surface layer including a back surface, an average crystal grain diameter is calculated as the square root of a value obtained by dividing the area of an observation region by the number of crystal grains contained in the observation region, where the observation region is in a thickness cross section parallel to the rolling direction and has a length in the rolling direction of 1800 μm and a length in the thickness direction of 1000 μm, which is expressed by $(1800\times1000/(\text{number of crystal grains contained in the observation region}))^{1/2}$, and a difference between the maximum and minimum values of the average crystal grain diameter is obtained from the 9 calculated average crystal grain diameters.

Difference between maximum and minimum values of crystal grain elongation rate

In the case of the hot-rolled and annealed ferritic stainless steel sheet according to aspects of the present invention, a difference between maximum and minimum values of a crystal grain elongation rate determined by using measuring method 2 below is 5.0 or less. In the case where the difference described above is more than 5.0, it is not possible to achieve good surface quality. There is no particular limitation on the lower limit of the difference, and the difference described above may be 0.

(Measuring Method 2)

At each of 9 observation positions, which are a surface layer including a front surface, a position at ⅛ of the thickness, a position at ⅜ of the thickness, a position at ⅜ of the thickness, a position at 4/8 of the thickness, a position at 5/8 of the thickness, a position at 6/8 of the thickness, a position at 7/8 of the thickness, and a surface layer including a back surface, an elongation rate is calculated by dividing a crystal grain length in the rolling direction by a crystal grain thickness in the thickness direction (elongation rate=crystal grain length in the rolling direction/crystal grain thickness in the thickness direction), where the observation region is in a thickness cross section parallel to the rolling direction and has a length in the rolling direction of 1800 μm and a length in the thickness direction of 1000 μm, where the crystal grain length in the rolling direction is calculated by dividing 1800 μm by an average number of crystal grain boundaries distributed in the rolling direction, which is obtained by drawing 5 lines having a length of 1800 μm in the rolling direction in the observation region, by counting the number of crystal grain boundaries intersecting each of the 5 lines, and by calculating the average value of the numbers counted on the 5 lines, (crystal grain length in the rolling direction=1800 μm/(average number of crystal grain boundaries distributed in the rolling direction)), and where the crystal grain thickness in the thickness direction is calculated by dividing 1000 μm by an average number of crystal grain boundaries distributed in the thickness direction, which is obtained by drawing 5 lines having a length of 1000 μm in the thickness direction in the observation region, by counting the number of crystal grain boundaries intersecting each of the 5 lines, and by calculating the average value of the numbers counted on the 5 lines, (crystal grain thickness in the thickness direction=1000 μm/(average number of crystal grain boundaries distributed in the thickness direction)), and a difference between the maximum and minimum values of the elongation rate is obtained from the 9 calculated elongation rates.

Here, in measuring method 1 and measuring method 2, the observation region (measurement region) at the observation position in the surface layer including a front surface has a length in the rolling direction of 1800 μm and a length in the thickness direction of 1000 μm as measured in the thickness direction (toward a back surface) from a front surface, the observation region at the observation position in the surface layer including a back surface has a length in the rolling direction of 1800 μm and a length in the thickness direction of 1000 μm as measured in the thickness direction (toward a front surface) from a back surface, and the observation region at each of the other observation positions has a length in the rolling direction of 1800 μm and a length in the thickness direction of 1000 μm with the center of the observation region being located at the corresponding specified observation position. In addition, part of the observation region at one of the observation positions may be included in the observation region at another observation position.

In addition, in measuring method 1, the number of crystal grains contained in the observation region is calculated by using the formula n1+(½)×n2, where the number (n1) of crystal grains completely contained in the observation region and the number (n2) of crystal grains partially contained in the observation region are manually counted.

In addition, in measuring method 2, when 5 lines having a length of 1800 μm in the rolling direction are drawn in the observation region at each of the observation positions, the lines are drawn so that the observation region is divided into 6 equal pieces in the thickness direction. In addition, when 5 lines having a length of 1000 μm in the thickness direction are drawn in the observation region at each of the observation positions, the lines are drawn so that the observation region is divided into 6 equal pieces in the rolling direction.

Thickness: 5.0 mm or more

Aspects of the present invention are intended to improve the surface quality of a hot-rolled and annealed ferritic stainless steel sheet which is used for thick parts after bending work has been performed. The term "thick parts" refers to parts having a thickness of 5.0 mm or more, and, in particular, in the case where the thickness is 7.0 mm or more, aspects of the invention have a significant effect. Although there is no particular limitation on the upper limit of the thickness, the upper limit is, for example, 20.0 mm or less.

Hereafter, the method for manufacturing the hot-rolled and annealed ferritic stainless steel sheet according to aspects of the present invention will be described.

First, molten steel having the chemical composition described above is prepared by using a known method, such as one using a converter, an electric furnace, or a vacuum melting furnace, and subjected to secondary refining by using, for example, a VOD (Vacuum Oxygen Decarburization) method or an AOD (Argon Oxygen Decarburization) method. Subsequently, the steel is made into a steel (slab) by using a continuous casting method or an ingot casting-slabbing method. This slab is subjected to a hot rolling process after the slab has been heated at a temperature of 1050° C. to 1150° C. for 1 hour to 24 hours, or the high-temperature slab is directly subjected to a hot rolling process without heating. In the hot rolling process, hot rolling is performed to obtain a thickness of 5.0 mm or more with a rolling finishing temperature of 800° C. to 950° C. The hot-rolled steel sheet obtained as described above is subjected to a hot-rolled-sheet annealing process of heating the steel sheet at a heating rate of 5° C./hour to 100° C./hour from a temperature of 200° C. to a hot-rolled-sheet annealing temperature of 700° C. to 900° C. and of holding the heated steel sheet at a temperature of 700° C. to 900° C. for 1 hour to 50 hours. After the hot-rolled-sheet annealing process, pickling and surface grinding may be performed as a descaling treatment to remove scale. The hot-rolled and annealed steel sheet from which scale has been removed may be subjected to skin pass rolling.

To decrease each of a variation in crystal grain diameter and a variation in crystal grain elongation rate to a corresponding one of the specified values after hot-rolled-sheet annealing has been performed, it is necessary to effectively apply homogeneous rolling strain to the whole steel sheet and to homogeneously heat the whole steel sheet without temperature variation while inhibiting, as much as possible, inhomogeneous recovery and recrystallization from locally occurring during rolling, by appropriately controlling the rolling finishing temperature, the heating rate for hot-rolled-sheet annealing, the hot-rolled sheet annealing temperature, and the holding time.

Rolling finishing temperature: 800° C. to 950° C.

To form a microstructure in which each of a variation in crystal grain diameter and a variation in crystal grain elongation rate is decreased to a corresponding one of the specified values after hot-rolled-sheet annealing has been performed, it is necessary to appropriately control the rolling finishing temperature to homogeneously form a sufficient number of recrystallization sites in the whole steel sheet by effectively applying homogeneous rolling strain, in particular, to the range from the surface layer in the thickness direction to the central portion in the thickness direction while preventing rolling strain, which is applied by performing hot rolling, from being disappeared through recovery.

In the case where the rolling finishing temperature is higher than 950° C., since there is a decrease in deformation resistance when rolling is performed, there is an increased tendency for shear strain due to shear deformation to be applied to the surface layer when rolling is performed, which makes it difficult to apply strain homogeneously in the thickness direction. In addition, since strain applied by performing rolling is rapidly recovered and partially recrystallized, it is not possible to effectively apply homogeneous rolling strain to the range from the surface layer in the thickness direction to the central portion in the thickness direction, which results in an insufficient number of recrystallization sites after the subsequent hot-rolled-sheet annealing process or in a variation in the timing of the recovery and recrystallization of strain when hot-rolled-sheet annealing is performed. Therefore, an inhomogeneous mixed-grain microstructure is formed after hot-rolled-sheet annealing has been performed, which makes it impossible to form a microstructure in which each of a variation in crystal grain diameter and a variation in crystal grain elongation rate is decreased to a corresponding one of the specified values. It is preferable that the rolling finishing temperature be as low as possible, because this makes shear deformation less likely to occur in the surface layer due to an increase in deformation resistance, which results in a homogeneous recrystallized microstructure being formed after the subsequent hot-rolled-sheet annealing process due to strain accumulated homogeneously in the thickness direction. However, in the case where the rolling finishing temperature is excessively lowered to less than 800° C., there is a significant increase in rolling load due to a decrease in the temperature of the steel sheet, which is not preferable from the viewpoint of manufacturability, and which may result in a deterioration in surface quality due to a rough surface occurring on the surface of the steel sheet. Therefore, to achieve homogeneity in the whole microstructure in the range from the surface layer in the thickness direction to the central portion in the thickness direction, the rolling finishing temperature is set to be 800° C. to 950° C. It is preferable that the rolling finishing temperature be 825° C. to 925° C. It is more preferable that the rolling finishing temperature be 850° C. to 900° C.

Heating rate: 5° C./hour to 100° C./hour

In accordance with aspects of the present invention, after the hot rolling process described above has been performed, cooling followed by hot-rolled-sheet annealing is performed on the hot-rolled steel sheet. In accordance with aspects of the present invention, the number of recrystallization sites is increased by effectively applying homogeneous rolling strain to the range from the surface layer in the thickness direction to the central portion in the thickness direction in the hot rolling process to promote the formation of a homogeneous microstructure in which each of a variation in crystal grain diameter and a variation in crystal grain elongation rate is decreased in the hot-rolled-sheet annealing process. To obtain such an effect, it is necessary that, after heating has been started in the hot-rolled-sheet annealing process, a heating rate be 5° C./hour to 100° C./hour from a temperature of 200° C. to a hot-rolled-sheet annealing temperature (soaking temperature) of 700° C. to 900° C. In the case where heating to the hot-rolled-sheet annealing temperature is performed at a heating rate of more than 100° C./hour, since there is an increased variation in temperature between the surface layer in the thickness direction and the central portion in the thickness direction, recrystallization behavior varies depending on the distance from the surface in the thickness direction in such a manner that, while a microstructure having small and equiaxed grains is formed in the surface layer in the thickness direction due to recrystallization sufficiently progressing, a microstructure having large and elongated grains is formed in the central portion in the thickness direction due to recovery or recrystallization partially occurring as a result of insufficient recrystallization caused by insufficient heat supply, which makes it impossible to form the specified microstructure which is homogeneous in the thickness direction. On the other hand, in the case where heating to the hot-rolled-sheet annealing temperature is performed at a heating rate of less than 5° C./hour, since no elongated grain is left due to sufficient recrystallization occurring, it is possible to form a microstructure having homogeneously shaped grains. However, since pinning sites are disappeared due to some of the carbonitrides, which have been precipitated in the hot rolling process, being redissolved, there is a significant increase in the grain diameter of some of the recrystallized grains, which makes it impossible to form a microstructure having a homogeneous and small grain diameter throughout a steel sheet due to an inhomogeneous mixed-grain microstructure being formed after hot-rolled-sheet annealing has been performed. In addition, there is a deterioration in productivity. Therefore, the lower limit of the heating rate is set to be 5° C./hour. It is preferable that the heating rate be 10° C./hour to 50° C./hour. Here, in accordance with aspects of the present invention, the heating rate in a temperature range of lower than 200° C. may be in or out of the range of 5° C./hour to 100° C./hour. This is because the heating rate has a small effect on a microstructure in the temperature range of lower than 200° C.

Holding at a temperature of 700° C. to 900° C. for 1 hour to 50 hours

In accordance with aspects of the present invention, a worked microstructure due to rolling formed in the hot rolling process is subjected to recrystallization in the hot-rolled-sheet annealing process. In accordance with aspects of the present invention, homogeneous rolling strain is effectively applied to the range from the surface layer in the thickness direction to the central portion in the thickness direction in the hot rolling process to increase the number of recrystallization sites to promote the formation of a homogeneous microstructure in which each of a variation in crystal grain diameter and a variation in crystal grain elongation rate is decreased to a corresponding one of the specified values when hot-rolled-sheet annealing is performed. To obtain such an effect, it is necessary that the hot-rolled steel sheet be held at a temperature of 700° C. to 900° C. In the case where the holding temperature is lower than 700° C., since sufficient recrystallization does not occur, while a microstructure has a small and homogeneous grain diameter in the surface layer in the thickness direction due to recovery or recrystallization partially occurring, a microstructure has elongated grains in the central portion in the thickness direction due to insufficient recrystallization, which makes it impossible to form a homogeneous microstructure in which a variation in crystal grain diameter and a variation in crystal grain elongation rate are decreased. On the other hand, in the case where the holding temperature is higher than 900° C., since sufficient recrystallization occurs, it is possible to form a homogeneous microstructure due to elongated grains being disappeared. However, since pinning sites are disappeared due to some of the carbonitrides, which have been precipitated in the hot rolling process, being redissolved, the grain diameter of some of the recrystallized grains increase significantly and an inhomogeneous mixed-grain microstructure is formed after hot-rolled-sheet annealing has been performed, which makes it impossible to form a microstructure having a homogeneous and small grain diameter throughout a steel sheet. Therefore, to achieve homogeneity in the whole microstructure in the range from the surface layer in the thickness direction to the central portion in the thickness direction, the holding temperature of the hot-rolled steel sheet is set to be 700° C. to 900° C. It is preferable that the holding temperature be 750° C. to 850° C.

In addition, to achieve homogeneity in the whole microstructure in the range from the surface layer in the thickness direction to the central portion in the thickness direction, not only the holding temperature of the hot-rolled steel sheet but also holding time is also important, and it is necessary that the holding time in the specified holding temperature range when hot-rolled-sheet annealing is performed be 1 hour to 50 hours to achieve a homogeneous microstructure. In the case where the holding time is less than 1 hour, since there is an increased variation in temperature between the surface layer in the thickness direction and the central portion in the thickness direction, recrystallization behavior varies depending on the distance from the surface in the thickness direction in such a manner that, while a microstructure having small and equiaxed grains is formed in the surface layer in the thickness direction due to recrystallization sufficiently progressing, a microstructure having large and elongated grains is formed in the central portion in the thickness direction due to recovery or recrystallization partially occurring as a result of insufficient recrystallization caused by insufficient heat supply, which makes it impossible to form the specified microstructure which is homogeneous in the thickness direction. On the other hand, in the case where the holding time is more than 50 hours, since no elongated grain is left due to sufficient recrystallization occurring, it is possible to form a microstructure having homogeneously shaped grains. However, since pinning sites are disappeared due to some of the carbonitrides, which have been precipitated in the hot rolling process, being redissolved, there is a significant increase in the grain diameter of some of the recrystallized grains, which makes it impossible to form a microstructure having a homogeneous and small crystal grain diameter throughout a steel sheet due to an inhomogeneous mixed-grain microstructure being formed after hot-rolled-sheet annealing has been performed. It is preferable that the holding time be 5 hours to 30 hours. Here, even when heating is performed before soaking is performed or when cooling is performed after soaking has been performed, the time for which the temperature of the steel sheet is within the temperature range of 700° C. to 900° C. is included in the holding time. That is, in the case where the hot-rolled-sheet annealing temperature is 700° C. to 900° C., the holding time in the temperature range of 700° C. to 900° C. includes the time for heating form a temperature of 700° C. to the hot-rolled-sheet annealing temperature, the holding time (soaking time) at the hot-rolled-sheet annealing temperature, and the time for cooling from the hot-rolled-sheet annealing temperature to a temperature of 700° C. In addition, there is no limitation on the cooling rate in the cooling stage at a temperature of lower than 700° C. after hot-rolled-sheet annealing has been performed.

The temperature when hot rolling or hot-rolled-sheet annealing is performed is defined as the surface temperature of the steel sheet determined in a non-contact manner by using a radiation thermometer having an emissivity of 0.8.

The obtained hot-rolled and annealed steel sheet may be subjected to a descaling treatment as needed by using a shot blasting method or a pickling method. Moreover, grinding, polishing, and the like may be performed to improve surface quality. In addition, the hot-rolled and annealed steel sheet according to aspects of the present invention may further be subjected to cold rolling and cold-rolled-sheet annealing.

The hot-rolled and annealed ferritic stainless steel sheet according to aspects of the present invention can preferably be used in applications in which bending work is performed. The thickness of the steel sheet is 5.0 mm or more. Although there is no particular limitation, the thickness of the steel sheet may be, for example, 20.0 mm or less or 15.0 mm or less.

Example 1

Hereafter the present invention will be described in detail in accordance with examples. The technical scope of the present invention is not limited to the examples below.

Molten steels having the chemical compositions given in Table 1 (and a balance of Fe and inevitable impurities) were prepared by using a small vacuum melting furnace and made into steel ingots having a weight of 50 kg. These steel ingots were subjected to hot rolling under the conditions given in Table 2 (hot rolling process). The heating temperature of the steel ingot when hot rolling was performed was 1100° C. and the holding time of heating was 30 minutes. Subsequently, these hot-rolled steel sheets were subjected to hot-rolled-sheet annealing under the conditions given in Table 2 (hot-rolled-sheet annealing process).

Test pieces were taken from the hot-rolled and annealed steel sheets obtained as described above to evaluate their microstructures and surface quality after bending work had been performed.

(1) Microstructure Evaluation

By taking a test piece having the thickness of the steel sheet, a width of 10 mm, and a length of 15 mm so that the longitudinal direction of the test piece was the rolling direction, and by performing etching by using aqua regia to expose crystal grain boundaries, an L-cross section parallel to the rolling direction was observed. The observation was performed at each of 9 observation positions in the thickness direction, which are a surface layer including a front rolling surface, a position at ⅛ of the thickness, a position at ⅜ of the thickness, a position at ⅜ of the thickness, a position at ⅝ of the thickness, a position at ⅝ of the thickness, a position at ⅞ of the thickness, and a surface layer including a back rolling surface. The observation region in which an average crystal grain diameter and a crystal grain elongation rate were determined had a length in the rolling direction of 1800 μm and a length in the thickness direction of 1000 μm. The average crystal grain diameter was calculated as the square root of a value obtained by dividing the area of the observation region by the number of crystal grains contained in the observation region, which is expressed by $(1800\times1000/(\text{number of crystal grains contained in the observation region}))^{1/2}$, and a difference between the maximum and minimum values of the average crystal grain diameter was obtained from the 9 calculated average crystal grain diameters. The elongation rate of the crystal grain was calculated by dividing a crystal grain length in the rolling direction by a crystal grain thickness in the thickness direction, where the crystal grain length in the rolling direction was calculated by dividing 1800 μm by an average number of crystal grain boundaries distributed in the rolling direction, which was obtained by drawing 5 lines having a length of 1800 μm in the rolling direction in the observation region so that the observation region was divided into 6 equal pieces in the thickness direction, by counting the number of crystal grain boundaries intersecting each of the 5 lines drawn in the rolling direction, and by calculating the average value of the numbers counted on the 5 lines, and where the crystal grain thickness in the thickness direction was calculated by dividing 1000 μm by an average number of crystal grain boundaries distributed in the thickness direction, which was obtained by drawing 5 lines having a length of 1000 μm in the thickness direction in the observation region so that the observation region was divided into 6 equal pieces in the rolling direction, by counting the number of crystal grain boundaries intersecting each of the 5 lines drawn in the thickness direction, and by calculating the average value of the numbers counted on the 5 lines, and a difference between the maximum and minimum values of the elongation rate is obtained from the 9 calculated elongation rates.

(2) Surface Quality Evaluation after Bending Work has been Performed

A bending test was performed by using a press bending method in accordance with JIS Z 2248:2006 "Metallic materials-Bend test". The test piece had the thickness of the steel sheet, a width of 40 mm, and a length of 200 mm, and the longitudinal direction of the test piece was a direction (C-direction) perpendicular to the rolling direction. The bending radius was 20 mm, and the bending angle was 120°. Regarding the surface quality, by obtaining a roughness curve in a direction perpendicular to the bending ridge line by using a One-shot 3D Measurement Microscope VR-3100, made by Keyence Corporation, in accordance with JIS B 0601-2001, the maximum height Rz was determined. The measurement length was 2.0 cm with the center of the measurement position being located on the ridge line at the bending position, that is, 1.0 cm each on both sides of the ridge line. A case where the maximum height Rz of the roughness curve in a direction perpendicular to the bending ridge line was 100 μm or less was judged as a case of good surface quality after bending work, that is, "○". A case where the maximum height Rz was more than 100 μm was judged as a case of poor surface quality after bending work, that is, "x". The results are given in the column "Surface Quality after Bending Work" in Tables 2.

As indicated in Table 2, all the example steels of the present invention had excellent surface quality after bending work had been performed. In contrast, the comparative steels, which were out of the range of the present invention, had poor surface quality after bending work had been performed.

TABLE 1

| Steel | Chemical Composition (mass %) | | | | | | | | | | | |
|---|---|---|---|---|---|---|---|---|---|---|---|---|
| Grade | C | Si | Mn | P | S | Cr | Ni | Al | N | Ti | Other | Note |
| A | 0.009 | 0.63 | 0.35 | 0.047 | 0.0068 | 17.3 | 0.12 | 0.023 | 0.016 | 0.33 | — | Example Steel |
| B | 0.007 | 0.15 | 0.24 | 0.033 | 0.0015 | 11.2 | 0.24 | 0.061 | 0.006 | 0.15 | — | Example Steel |
| C | 0.004 | 0.33 | 0.31 | 0.008 | 0.0048 | 15.1 | 0.18 | 0.087 | 0.012 | 0.07 | Cu: 0.21, Nb: 0.05 | Example Steel |
| D | 0.015 | 0.22 | 0.44 | 0.017 | 0.0056 | 13.6 | 0.35 | 0.008 | 0.009 | 0.24 | Co: 0.08, Zr: 0.04 | Example Steel |
| E | 0.010 | 0.34 | 0.29 | 0.026 | 0.0008 | 10.7 | 0.09 | 0.043 | 0.007 | 0.22 | V: 0.05, Y: 0.04, REM: 0.04 | Example Steel |
| F | 0.021 | 0.29 | 0.15 | 0.009 | 0.0016 | 12.4 | 0.27 | 0.034 | 0.015 | 0.28 | Mo: 0.36 | Example Steel |
| G | 0.009 | 0.24 | 0.29 | 0.035 | 0.0038 | 10.8 | 0.19 | 0.029 | 0.008 | 0.24 | — | Example Steel |
| H | 0.008 | 0.27 | 0.36 | 0.042 | 0.0025 | 11.2 | 0.15 | 0.037 | 0.013 | 0.22 | B: 0.0009, Ca: 0.0006 | Example Steel |
| I | 0.011 | 0.28 | 0.25 | 0.025 | 0.0035 | 11.6 | 0.58 | 0.035 | 0.011 | 0.25 | Sn: 0.018, Sb: 0.011, Mg: 0.0011 | Example Steel |
| J | 0.028 | 0.22 | 0.37 | 0.032 | 0.0045 | 11.5 | 0.14 | 0.052 | 0.004 | 0.32 | — | ComparativeSteel |
| K | 0.005 | 0.36 | 0.26 | 0.053 | 0.0055 | 12.5 | 0.15 | 0.065 | 0.008 | 0.37 | — | ComparativeSteel |
| L | 0.007 | 0.17 | 0.22 | 0.024 | 0.0042 | 13.5 | 0.24 | 0.113 | 0.012 | 0.22 | — | ComparativeSteel |
| M | 0.022 | 0.27 | 0.33 | 0.014 | 0.0033 | 14.5 | 0.33 | 0.033 | 0.018 | 0.43 | — | ComparativeSteel |

Underlined portions in Table 1 indicate items out of the range of the present invention.

TABLE 2

| Code | Steel Grade | Rolling Finishing Temperature (° C.) | Heating Rate*1 (° C./hour) | Hot-rolled-sheet Annealing Temperature (° C.) | Holding Time at a Temperature of 700° C. to 900° C. (hour) | Thickness (mm) | Difference between Maximum and Minimum Values of Average Crystal Grain Diameter Distributed in Thickness Direction (μm) | Difference between Maximum and Minimum Values of Crystal Grain Elongation Rate Distributed in Thickness Direction | Maximum Height of Roughness Curve in Direction Perpendicular to Bending Ridge Line after 120°-V-bend Work with a Bending Radius of 20 mm (μm) | Surface Quality after Bending Work ○: Good x: Poor | Note |
|---|---|---|---|---|---|---|---|---|---|---|---|
| 1 | A | 825 | 93 | 840 | 14.7 | 5.1 | 45 | 1.2 | 89 | ○ | Example Steel |
| 2 | B | 840 | 30 | 820 | 26.1 | 8.0 | 34 | 2.4 | 93 | ○ | Example Steel |
| 3 | C | 855 | 23 | 860 | 24.4 | 9.9 | 25 | 3.3 | 53 | ○ | Example Steel |
| 4 | D | 890 | 20 | 780 | 43.7 | 14.4 | 36 | 0.7 | 90 | ○ | Example Steel |
| 5 | E | 900 | 15 | 730 | 4.8 | 11.1 | 48 | 1.6 | 86 | ○ | Example Steel |
| 6 | F | 880 | 8 | 780 | 22.7 | 5.9 | 42 | 2.2 | 75 | ○ | Example Steel |
| 7 | G | 860 | 18 | 800 | 19.4 | 9.1 | 33 | 0.5 | 53 | ○ | Example Steel |
| 8 | H | 855 | 25 | 820 | 19.9 | 14.2 | 21 | 0.8 | 88 | ○ | Example Steel |
| 9 | I | 850 | 30 | 800 | 17.2 | 11.9 | 16 | 0.3 | 72 | ○ | Example Steel |

TABLE 2-continued

| Code | Steel Grade | Rolling Finishing Temperature (° C.) | Heating Rate*1 (° C./hour) | Hot-rolled-sheet Annealing Temperature (° C.) | Holding Time at a Temperature of 700° C. to 900° C. (hour) | Thickness (mm) | Difference between Maximum and Minimum Values of Average Crystal Grain Diameter Distributed in Thickness Direction (μm) | Difference between Maximum and Minimum Values of Crystal Grain Elongation Rate Distributed in Thickness Direction | Maximum Height of Roughness Curve in Direction Perpendicular to Bending Ridge Line after 120°-V-bend Work with a Bending Radius of 20 mm (μm) | Surface Quality after Bending Work ○: Good x: Poor | Note |
|---|---|---|---|---|---|---|---|---|---|---|---|
| 10 | A | 975 | 30 | 880 | 24.6 | 8.1 | 90 | 5.4 | 148 | x | ComparativeSteel |
| 11 | C | 910 | 2 | 760 | 37.5 | 10.1 | 83 | 3.3 | 127 | x | ComparativeSteel |
| 12 | C | 885 | 120 | 810 | 15.4 | 11.9 | 68 | 5.8 | 134 | x | ComparativeSteel |
| 13 | E | 860 | 40 | 600 | — | 8.1 | 75 | 6.1 | 162 | x | ComparativeSteel |
| 14 | E | 845 | 35 | 1100 | 17.5*2 | 8.0 | 86 | 2.1 | 134 | x | ComparativeSteel |
| 15 | H | 820 | 98 | 705 | 0.3 | 9.9 | 77 | 7.2 | 182 | x | ComparativeSteel |
| 16 | H | 865 | 7 | 860 | 57.3 | 14.0 | 98 | 1.5 | 143 | x | ComparativeSteel |
| 17 | J | 880 | 30 | 850 | 21.8 | 7.0 | 44 | 5.9 | 132 | x | ComparativeSteel |
| 18 | K | 855 | 25 | 830 | 20.8 | 13.8 | 35 | 6.3 | 141 | x | ComparativeSteel |
| 19 | L | 840 | 20 | 810 | 20.0 | 13.0 | 39 | 5.4 | 126 | x | ComparativeSteel |
| 20 | M | 825 | 15 | 790 | 19.3 | 4.9 | 42 | 6.9 | 152 | x | ComparativeSteel |

*1Heating rate from a temperature of 200° C. to the hot-rolled-sheet annealing temperature

*2A holding time at a temperature of 700° C. to 900° C. is given. A holding time at a temperature of 900° C. (not inclusive) to the hot-rolled-sheet annealing temperature was 19.7 hours.

Underlined portions in Table 2 indicate items out of the range of the present invention.

The invention claimed is:

1. A hot-rolled and annealed ferritic stainless steel sheet, having a thickness of 7.0 mm or more and a chemical composition containing, by mass %, C: 0.001% to 0.025%, Si :0.05% to 0.70%, Mn: 0.05% to 0.50%, P: 0.050% or less, S: 0.01% or less, Cr: 10.0% to 18.0%, Ni: 0.01% to 1.00%, Al: 0.001% to 0.10%, N: 0.001% to 0.025%, Ti: 0.01% to 0.40%, and a balance of Fe and inevitable impurities, wherein a difference between maximum and minimum values of an average crystal grain diameter determined by using measuring method 1 below is 50 μm or less, and wherein a difference between maximum and minimum values of a crystal grain elongation rate determined by using measuring method 2 below is 5.0 or less, (Measuring method 1)

at each of 9 observation positions, which are a surface layer including a front surface, a position at ⅛ of the thickness, a position at ⅜ of the thickness, a position at ⅜ of the thickness, a position at ⅝ of the thickness, a position at ⅝ of the thickness, a position at ⅞ of the thickness, and a surface layer including a back surface, an average crystal grain diameter is calculated as the square root of a value obtained by dividing the area of an observation region by the number of crystal grains contained in the observation region, where the observation region is in a thickness cross section parallel to a rolling direction and has a length in the rolling direction of 1800 μm and a length in a thickness direction of 1000 μm, which is expressed by $(1800\times 1000/(\text{number of crystal grains contained in the observation region}))^{L/2}$, and a difference between the maximum and minimum values of the average crystal grain diameter is obtained from the 9 calculated average crystal grain diameters, and (Measuring method 2)

at each of 9 observation positions, which are a surface layer including a front surface, a position at ⅛ of the thickness, a position at ⅜ of the thickness, a position at ⅜ of the thickness, a position at ⅝ of the thickness, a position at ⅝ of the thickness, a position at ⅞ of the thickness, and a surface layer including a back surface, an elongation rate is calculated by dividing a crystal grain length in the rolling direction by a crystal grain thickness in the thickness direction, where the observation region is in a thickness cross section parallel to the rolling direction and has a length in the rolling direction of 1800 μm and a length in the thickness direction of 1000 μm, where the crystal grain length in the rolling direction is calculated by dividing 1800 μm by an average number of crystal grain boundaries distributed in the rolling direction, which is obtained by drawing 5 lines having a length of 1800 μm in the rolling direction in the observation region, by counting the number of crystal grain boundaries intersecting each of the 5 lines, and by calculating the average value of the numbers counted on the 5 lines, and where the crystal grain thickness in the thickness direction is calculated by dividing 1000 μm by an average number of crystal grain boundaries distributed in the thickness direction, which is obtained by drawing 5 lines having a length of 1000 μm in the thickness direction in the observation region, by counting the number of crystal grain boundaries intersecting each of the 5 lines, and by calculating the average value of the numbers counted on the 5 lines, and a difference between the maximum and minimum values of the elongation rate is obtained from the 9 calculated elongation rates.

2. The hot-rolled and annealed ferritic stainless steel sheet according to claim 1, wherein the chemical composition further contains, by mass%, one, two, or all of Cu: 0. 01% to 1.00%, Mo: 0.01% to 1.00%, and Co: 0.01% to 0.50%.

3. The hot-rolled and annealed ferritic stainless steel sheet according to claim 1, wherein the chemical composition further contains, by mass %, one, two, or more selected from V: 0.01% to 0.10%, Zr: 0.01% to 0.10%, Nb: 0.01% to 0.10%, B:0. 0003% to 0.0030%, Mg: 0.0005% to 0.0030%, Ca: 0.0003% to 0.0030%, Y: 0.01% to 0.20%, REM (rare-earth metal): 0.01% to 0.10%, Sn: 0.001% to 0.500%, and Sb: 0.001% to 0.500%.

4. The hot-rolled and annealed ferritic stainless steel sheet according to claim 2, wherein the chemical composition further contains, by mass %, one, two, or more selected from V: 0.01% to 0.10%, Zr: 0.01% to 0.10%, Nb: 0.01% to 0.10%, B: 0. 0003% to 0.0030%, Mg: 0.0005% to 0.0030%, Ca: 0.0003% to 0.0030%, Y: 0.01% to 0.20%, REM (rare-earth metal): 0.01% to 0.10%, Sn: 0.001% to 0.500%, and Sb: 0.001% to 0.500%.

5. A method for manufacturing the hot-rolled and annealed ferritic stainless steel sheet according to claim 2, the method comprising:

a hot rolling process of performing hot rolling with a rolling finishing temperature of 800° C. to 950° C. to obtain a hot-rolled steel sheet; and a process of performing hot-rolled-sheet annealing on the hot-rolled steel sheet by heating the hot-rolled steel sheet at a heating rate of 5° C/hour to 100° C/hour from a temperature of 200° C. to a hot-rolled-sheet annealing temperature of 700° C. to 900° C. and by holding the heated steel sheet at a temperature of 700° C. to 900° C. for 1 hour to 50 hours.

6. A method for manufacturing the hot-rolled and annealed ferritic stainless steel sheet according to claim 4, the method comprising:

a hot rolling process of performing hot rolling with a rolling finishing temperature of 800° C. to 950° C. to obtain a hot-rolled steel sheet; and a process of performing hot-rolled-sheet annealing on the hot-rolled steel sheet by heating the hot-rolled steel sheet at a heating rate of 5° C/hour to 100° C/hour from a temperature of 200° C. to a hot-rolled-sheet annealing temperature of 700° C. to 900° C. and by holding the heated steel sheet at a temperature of 700° C. to 900° C. for 1 hour to 50 hours.

7. A method for manufacturing the hot-rolled and annealed ferritic stainless steel sheet according to claim 3, the method comprising:

a hot rolling process of performing hot rolling with a rolling finishing temperature of 800° C. to 950° C. to obtain a hot-rolled steel sheet; and a process of performing hot-rolled-sheet annealing on the hot-rolled steel sheet by heating the hot-rolled steel sheet at a heating rate of 5° C/hour to 100° C/hour from a temperature of 200° C. to a hot-rolled-sheet annealing temperature of 700° C. to 900° C. and by holding the heated steel sheet at a temperature of 700° C. to 900° C. for 1 hour to 50 hours.

8. A method for manufacturing the hot-rolled and annealed ferritic stainless steel sheet according to claim 1, the method comprising:

a hot rolling process of performing hot rolling with a rolling finishing temperature of 800° C. to 950° C. to obtain a hot-rolled steel sheet; and a process of performing hot-rolled-sheet annealing on the hot-rolled steel sheet by heating the hot-rolled steel sheet at a heating rate of 5° C/hour to 100° C/hour from a temperature of 200° C. to a hot-rolled-sheet annealing temperature of 700° C. to 900° C. and by holding the heated steel sheet at a temperature of 700° C. to 900° C. for 1 hour to 50 hours.

* * * * *